US005108346A

United States Patent [19]

Ashby

[11] Patent Number: 5,108,346

[45] Date of Patent: Apr. 28, 1992

[54] RETAINING A PART WITHIN A BUSINESS FORM

[75] Inventor: Robert E. Ashby, Quakertown, Pa.

[73] Assignee: Moore Business Forms, Inc., Grand Island, N.Y.

[21] Appl. No.: 485,882

[22] Filed: Feb. 27, 1990

[51] Int. Cl.[5] ..... B41L 1/26

[52] U.S. Cl. ..... 462/6; 229/69; 462/2; 462/3

[58] Field of Search ..... 229/69; 462/2, 3, 6

[56] References Cited

U.S. PATENT DOCUMENTS

| | | | |
|---|---|---|---|
| 1,761,106 | 6/1930 | Dencklau | 462/3 |
| 2,105,449 | 1/1938 | Brenn | 462/2 |
| 2,148,387 | 2/1939 | Wellner | 462/3 |
| 2,156,142 | 4/1939 | Blitz | 462/64 |
| 3,211,469 | 10/1965 | Chamberlain | 462/6 |
| 3,554,438 | 1/1971 | Van Malderghem | 229/69 |
| 3,955,750 | 5/1976 | Huffman | 229/69 |
| 4,002,290 | 1/1977 | Van Malderghem | 229/69 |
| 4,277,016 | 7/1981 | Wakeman et al. | 229/69 |
| 4,403,696 | 9/1983 | Newell | 229/69 X |
| 4,741,475 | 5/1988 | Norman | 229/69 |

OTHER PUBLICATIONS

"Speedimailer ® is Easy to Use", demonstration form, Moore Business Forms.

"Universal Demonstration Form", Moore Business Forms.

*Primary Examiner*—Paul A. Bell

*Attorney, Agent, or Firm*—Nixon & Vanderhye

[57] ABSTRACT

A mailer type of business form having a carbonizing bond sheet with a carbon spot on one face, and an insert, is constructed so that the carbonizing bond sheet will remain within the outgoing envelope when the insert is removed. This is accomplished even though the carbon spot goes all the way to the end of the carbonizing sheet by providing thumb notches in the outgoing envelope plies and the carbonizing bond, but not in the insert. The carbonizing bond is stream pasted to the interior top ply of the outgoing envelope to maintain it within the outgoing envelope when the insert is removed. The mailer is constructed in a continuous manner from four vertically aligned webs of paper, with the interior webs having a width less than the top and bottom webs by an amount corresponding to the width of strips of adhesive along the sides of the business forms holding the top and bottom plies together. All the webs except the insert sheet web are thumb notched, and the carbonizing bond and insert web are simultaneously die cut.

16 Claims, 5 Drawing Sheets

RETAINING A PART WITHIN A BUSINESS FORM

BACKGROUND AND SUMMARY OF THE INVENTION

In the production of business forms commonly known as mailers, it is often very desirable to provide a carbonizing bond sheet with a carbon spot on the back of it in the interior of the outgoing envelope of the mailer so that address, or other variable information, that is to be printed on an insert within the mailer can be so-printed even after the mailer has been constructed (that is by the entity that sends the mailer to the end user). There have been many techniques for doing this in the past. In some cases, the carbon spot has been placed directly on the top ply of the outgoing envelope, however this means that the top ply must be of carbonizing bond, and the aesthetic effect of this form construction is not desirable to many users. There have been other situations in which the carbon spot sheet of carbonizing bond was distinct from the outgoing envelope top ply, however in order to ensure that the carbon sheet was not removed with the insert, the carbon sheet had to terminate short of the thumb notch associated with the tear down perf conventionally utilized for opening the outgoing envelope to facilitate removal of the insert. This provided problems in constructing the mailer, and also meant that variable information to be printed on the insert must also terminate a half inch from the end, which may be undesirable.

According to the present invention a mailer type business form is provided which allows a carbon insert to extend the complete width of the form, yet will remain within the outgoing envelope when the insert is removed by the end user. The mailer according to the invention may be produced in a simple, continuous manner to effectively provide the end features that are desirable.

According to one aspect of the present invention a mailer type business form is provided which comprises the following elements: An outgoing envelope formed by a top-ply and a bottom ply, each ply having an outside face and an inside face, and first and second side edges, and first and second end edges. First means (e.g. adhesive) for operatively connecting the top and bottom plies together along the side edges. Second means (e.g. adhesive) for operatively connecting the top and bottom plies together along the end edges. First perforation means spaced from the first end edges and generally parallel thereto, for facilitating separation of the end edges from both the plies to allow access from the first end to an interior volume between the plies. A carbonizing bond sheet having a first face and a second face and first and second ends, the second face having a carbon spot thereon extending to the first end, and the first face in contact with the top ply interior face; the carbonizing bond sheet having a width less than the width of the plies and a length less than the length of the plies. Means for attaching the carbonizing bond sheet second end to the top ply interior surface adjacent the top ply second end, so that the carbonizing bond sheet first end is adjacent the first perforation means, and the carbon spot extends to the first perforation means. And, an insert sheet, disposed between the plies and unconnected to the plies at least along the sides, the insert sheet having length and width dimensions less than those of the plies and comparable to those of the carbonizing bond sheet, the carbon spot in contact with a face of the insert sheet. Also there preferably are provided cooperating thumb perforation means formed in the top and bottom plies of the outgoing envelope and extending from the first perforation means toward the plies' second ends, and at the first end in the carbonizing bond sheet. The insert sheet is devoid of cooperating thumb perforation means. The carbonizing bond sheet second end is typically attached to the top ply interior surface by stream pasting.

According to another aspect of the present invention there is provided a method of making a business form from first, second, third and fourth continuous webs of paper, each web having first and second faces. The second web is of carbonizing bond and has a carbon spot on the second face thereof. The method comprises the steps of: (a) Assembling the webs together as they move in a direction of conveyance juxtaposed so that from the top to the bottom they comprise the first, second, third, and fourth webs, with the first face of each web on top. Prior to step (a): (b) Forming cooperating thumb notch perforations in the first, second, and fourth webs. (c) Applying adhesive to at least one of the first and fourth webs along the second face of the first web or first face of the fourth web perpendicular to the direction of conveyance, at the sides of a business form to be formed. (d) Applying adhesive to at least one of the second face of the first web or first face of the second web in the direction of conveyance to attach the second web to the first web along a strip. (e) Simultaneously die cutting the second and third webs, and, (f) applying adhesive to at least one of the first web second face or fourth web first face in the direction of conveyance at strips at the ends of a business form to be formed, to attach the first and fourth webs together, but not to the second and third webs. And after step (a), (g) perforating the assembled webs perpendicular to the direction of conveyance so that they are formed into discrete business forms interconnected at the perforations.

It is the primary object of the present invention to provide for an easily constructed mailer type business form having a carbon sheet within the outgoing envelope that is not removed when the insert is removed. This and other objects of the invention will become clear from an inspection of the detailed description of the invention and from the appended claims.

DETAILED DESCRIPTION OF THE DRAWINGS

Figure 1:
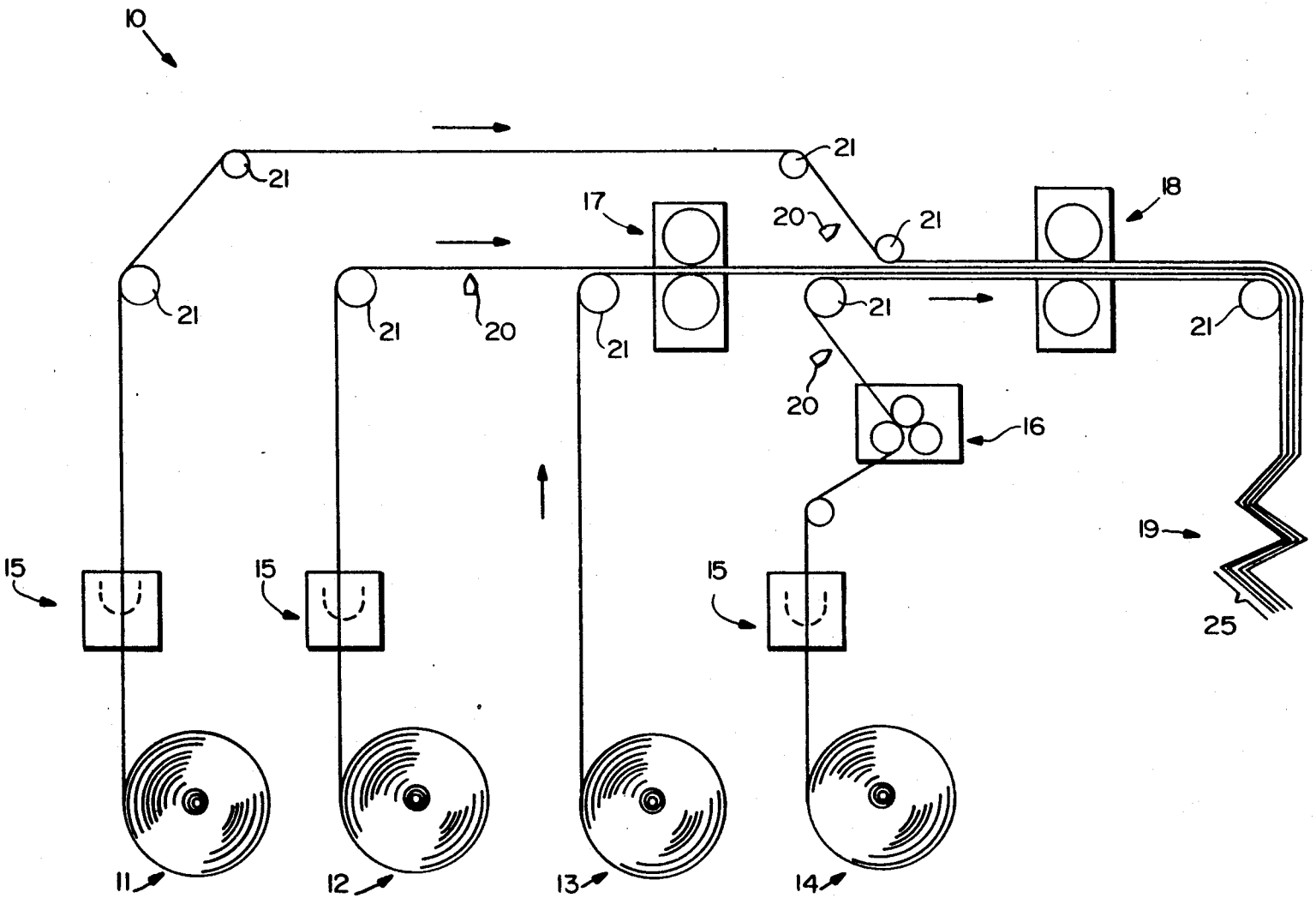
FIG. 1 is a side schematic view showing apparatus used in the manufacture of business forms according to the present invention.

FIG. 1 schematically illustrates an apparatus 10 that is utilizable to manufacture mailer type business forms according to the present invention in a continuous manner. All of the individual components of the apparatus 10 are conventional per se in the art, and may be purchased off the shelf.

The apparatus is illustrated generally by reference numeral 10 and includes four paper webs 11, 12, 13, and 14. Other rolls of paper webs may also be provided between the webs 13 and 14, if desired. The webs 11 through 14 are continuous and have top and bottom surfaces and when juxtaposed the top surface of one, which may be considered a first face, engages the bottom or second face of the overlying web. The first web 11 ultimately will be constructed to provide the top ply of a business form to be produced, the second web 12 is of carbonizing bond and has carbon spots formed on the second (bottom) face thereof, the third web 13 provides the insert sheet, and the fourth web 14 provides the bottom ply of the outgoing envelope.

Associated with the webs 11, 12, and 14 is a thumb notcher 15 for providing a thumb notch perforation in each of the webs 11, 12, and 14 at one location for each discrete form to be ultimately provided. No notching is provided of the insert sheet web 13. An across-web adhesive applicator 16 is utilized to apply adhesive perpendicular to the direction of conveyance of the web 14 at spaced points therealong which will correspond to the side edges of the discrete business forms to be ultimately produced. A die cut chip removal unit 17 is provided for simultaneously die cutting the webs 12, 13 so that in the final form produced the interior sheets from the webs 12, 13 will have a width which is less than the width of the top and bottom plies 11, 14 by an amount equal to about the thickness of the adhesive strips that are applied. The devices 20 comprise lengthwise adhesive applicators for applying adhesive at various points along the direction of conveyance.

After the webs are assembled together as they move in the direction of conveyance, they are acted upon by a horizontal perforating unit 18 to separate the webs into discrete forms 25. The webs may already have perforations formed along the direction of conveyance while on the rolls of paper. After perforating in unit 18, the discrete business forms 25 are folded by a folding unit 19 or the like. During the manufacture in apparatus 10, the webs pass over or around a plurality of rolls 21.

Utilizing the apparatus 10, it is possible to make a business form from first (11), second (12), third (13), and fourth (14) continuous webs of paper each having first and second faces, with the second web 12 of carbonizing bond and having a carbon spot on the second face thereof. The basic method step is (a) assembling the webs 11-14 together as they move in a direction of conveyance so that from the top to the bottom the webs are juxtaposed so that from the top to the bottom they comprise the first, second, third, and fourth webs with the first face of each web on top. Prior to step (a) are the steps: (b) forming cooperating thumb notch perforations (with structure 15) in the first 11, second 12, and fourth 14 webs; (c) applying adhesive (with structure 16) to at least one of the first 11 and fourth 14 webs (just the web 14 in the illustrative embodiment indicated in the drawings) along the second face of the first web or the first face of the fourth web perpendicular to the direction of conveyance, at the sides of a business form to be formed; (d) applying adhesive (utilizing structures 20) to at least one of the second face of the first web 11 or first face of the second web 12 in the direction of conveyance along a strip for attaching (i.e. stream pasting) the second web 12 to the first web 11; (e) simultaneously die cutting the second and third webs 12, 13 so that they have a different width in the final business form to be produced than do the plies formed by the webs 11, 14; and (f) applying adhesive (utilizing structures 20) to at least one of the first web 11 second face or fourth web 14 first face and second web 12 second face or third web 13 second face in the direction of conveyance at strips at the ends of the business form to be formed, to attach the first, second, third and fourth webs together. Also, after step (a) there is a step (g) of perforating the assembled webs utilizing structure 18, perpendicular to the direction of conveyance so that they are formed into discrete business forms interconnected at the perforations. Also there is the step (h) of folding the business forms along the perforations forming the webs into discrete business forms utilizing the folder 19.

Figure 2:
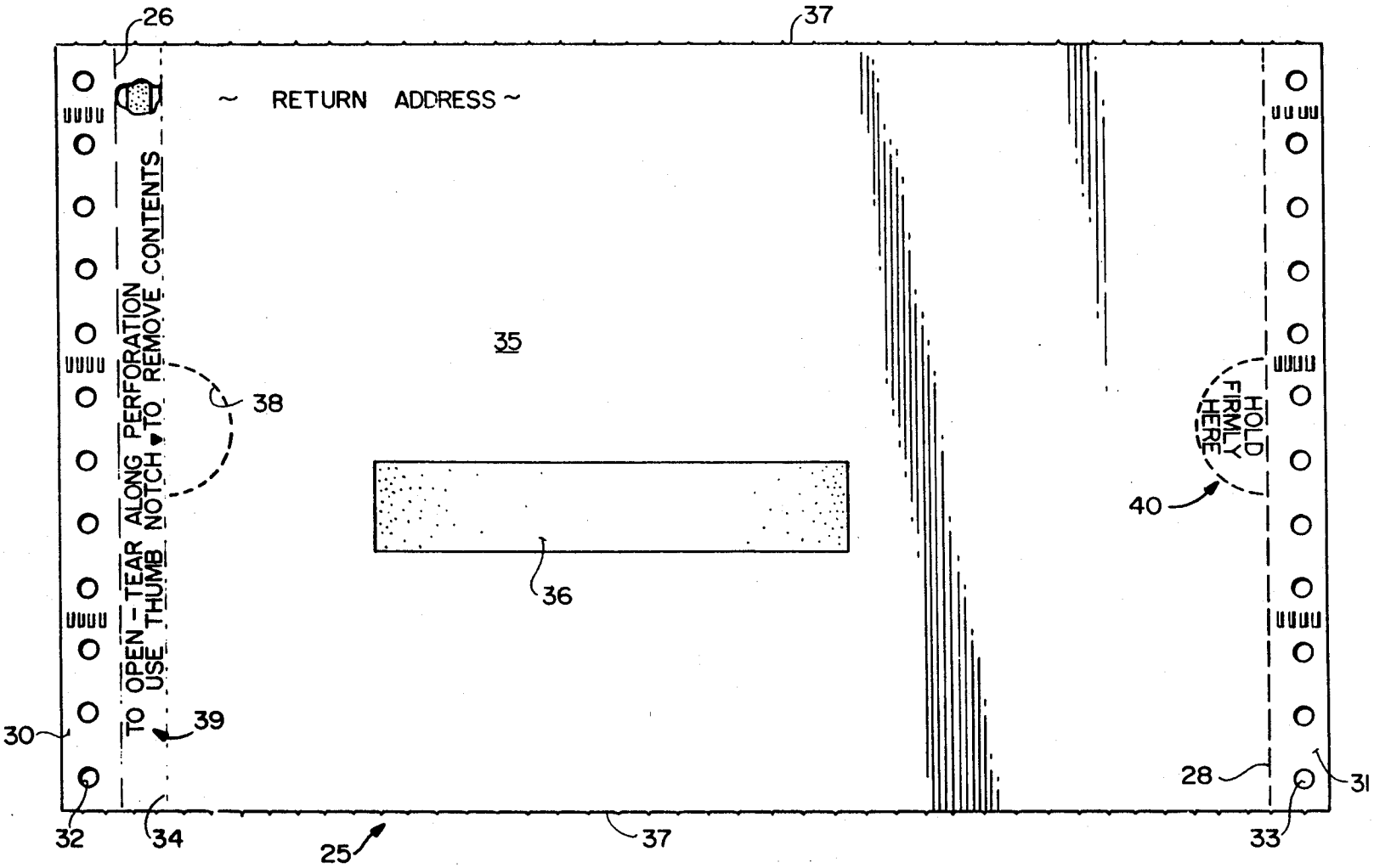
FIG. 2 is a top plan view of an exemplary business form manufactured according to the present invention.
Figure 3:
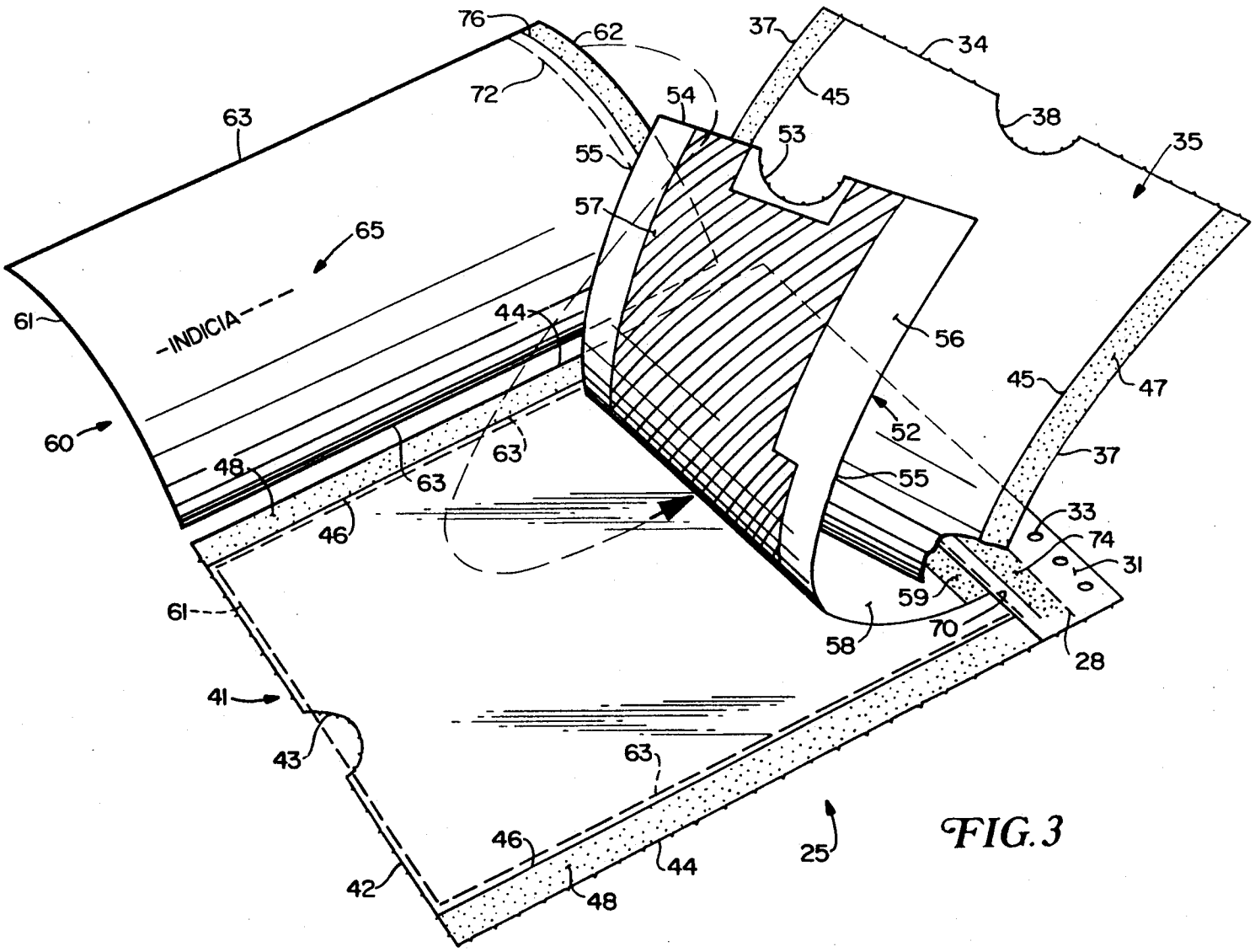
FIG. 3 is a top perspective view showing the form of FIG. 2 with the left tear down perforation removed, and folded back and exploded to show details of the individual components.

An exemplary mailer type business form according to the present invention is shown generally by reference numeral 25 in FIGS. 2 and 3. The form includes perforations 26, 28 at opposite ends thereof for separable tractor drive portions 30, 31 formed at what are the "ends" of the form 25. The openings 32, 33 are designed to cooperate with a conventional tractor drive. A conventional tear down perforation 34 is also provided adjacent the first end of the form to allow the form to be opened.

The form includes an outgoing envelope including a top ply of the outgoing envelope, 35, having an area 36 on which the address information is printed. The area 36 can have chromogen containing capsules that upon impact react to form print, or the area 36 can be printed with an inked ribbon or in a wide variety of other conventional manners. The sides 37 of the form are the perforated portions formed by the perforating apparatus 18 of FIG. 1, and connect each form 25 to other forms in a continuous array of forms, with each individual form being readily detachable along the side perforations 37. A thumb notch 38 is provided on the first end of the form adjacent the perforation 34, with instructions 39 for its use printed adjacent to it. Indicia 40 on the second end of the form 25 instruct the user to hold the form firmly at that area, and no thumb perforation or notch is provided thereat.

The top ply 35 of the outgoing envelope was formed from the sheet 11 in FIG. 1, and the bottom ply 41 of the outgoing envelope was formed from the web 14. The bottom ply 41 has the same width as the top ply 35 and has a first end 42 in alignment with the perforations 34 in the top ply 35, and side edges 44 which correspond to the side edges 37 of the top ply 35. Adhesive strips 47, 48 are provided on the bottom face of the top ply 35 and top face of the bottom ply 41, respectively. The adhesive strips 47, 48 may be provided on both plies 35, 41—as illustrated in FIG. 3—or only applied to one of them, as by utilizing just the apparatus 16 in FIG. 1. The inner edges of the adhesive strips 47 are indicated by reference numeral 45, while the inner edges of the adhesive strips 48 are indicated by reference numeral 46. The interior components of the form 25 are preferably disposed between the edges 45, 46 (that is they preferably have a width less than the width of the plies 35, 41 of the outgoing envelope) so that the interior components are preferably not attached to the plies 35, 41 along the sides thereof.

A carbonizing bond sheet 52 is disposed interiorly of the form 25, within the "envelope" formed by the plies 35, 41, having been constructed from the web 12 of FIG. 1. The sheet 52 has a thumb notch perforation 53 that was formed by the thumb notcher 15, and has a first end 54 which is aligned with the perforations 34, 42 of the plies 31, 41 (perhaps being spaced a very small amount inwardly thereof). The sheet 52 also has sides 55, the distance between the sides 55 (the "width") preferably being less than the spacing between the adhesive interior edges 45, 46. Disposed on the bottom or second face 56 of the sheet 52 is a carbon spot 57, which—as illustrated in FIG. 3—extends all the way to the edge 54, which in turn extends all the way to the perforations 34, 42. The top face 58 of the sheet 52 engages the bottom face of the top ply 35.

In order to hold the carbon sheet 52 within the envelope while still allowing the carbon spot 57 to extend all the way to the perforations 34, 42, attachment means exemplified by the adhesive strip 59 are preferably provided. The adhesive strip 59 has been applied by one of the adhesive applicators 20 (e.g. the one associated with the top ply 11) to the bottom face of the top ply 35, and/or the top face 58 of the carbon sheet 52. That is the carbon sheet 58 is stream pasted to the interior face of the top ply 35 adjacent the second end thereof (remote from the first end 54 of the carbon sheet 52).

Finally, an insert sheet 60 is also provided in the mailer 25. While the insert sheet 60 is illustrated as merely a single thickness piece of paper in the embodiment illustrated in the drawings, it is to be understood that it could be separate sheets of paper, or a multi-ply stack, including a return envelope. In the illustrated embodiment, however, the sheet 60 was formed from the web 13 and has a first edge 61 generally coincident with the edge 54 of the carbon sheet 52, and the perforations 34, 42. FIG. 3 shows the insert sheet 60 in solid line removed from the form 25, and in dotted line laid over the bottom ply 41. Note that there is no thumb perforation in the insert sheet 60.

The insert sheet 60 also has a second end 62 generally in alignment with the perforation 28, and side edges 63 which are disposed between the interior edges 45, 46 of the glue strips 47, 48. The insert 60 may have small paper ties (bridges) which remain after die cutting, at one or both of the ends 61, 62. Those ties are easily severed for removal of the sheet 60. The insert 60 is attached to the bottom ply 41 by glue line 76. The sheet 60 typically also has indicia 65 thereon. In addition to having pre-printed indicia, of course it will have indicia that is variable and is applied by the customer who sends the form 25 to an end user. The variable information indicia is applied merely by impact printing (with either an inked or non-inked ribbon depending upon whether it is desirable to also apply the information to the outside of the envelope) on top ply 35, the impact being transferred to the carbon spot 57 and ultimately to the sheet 60.

Figure 4:
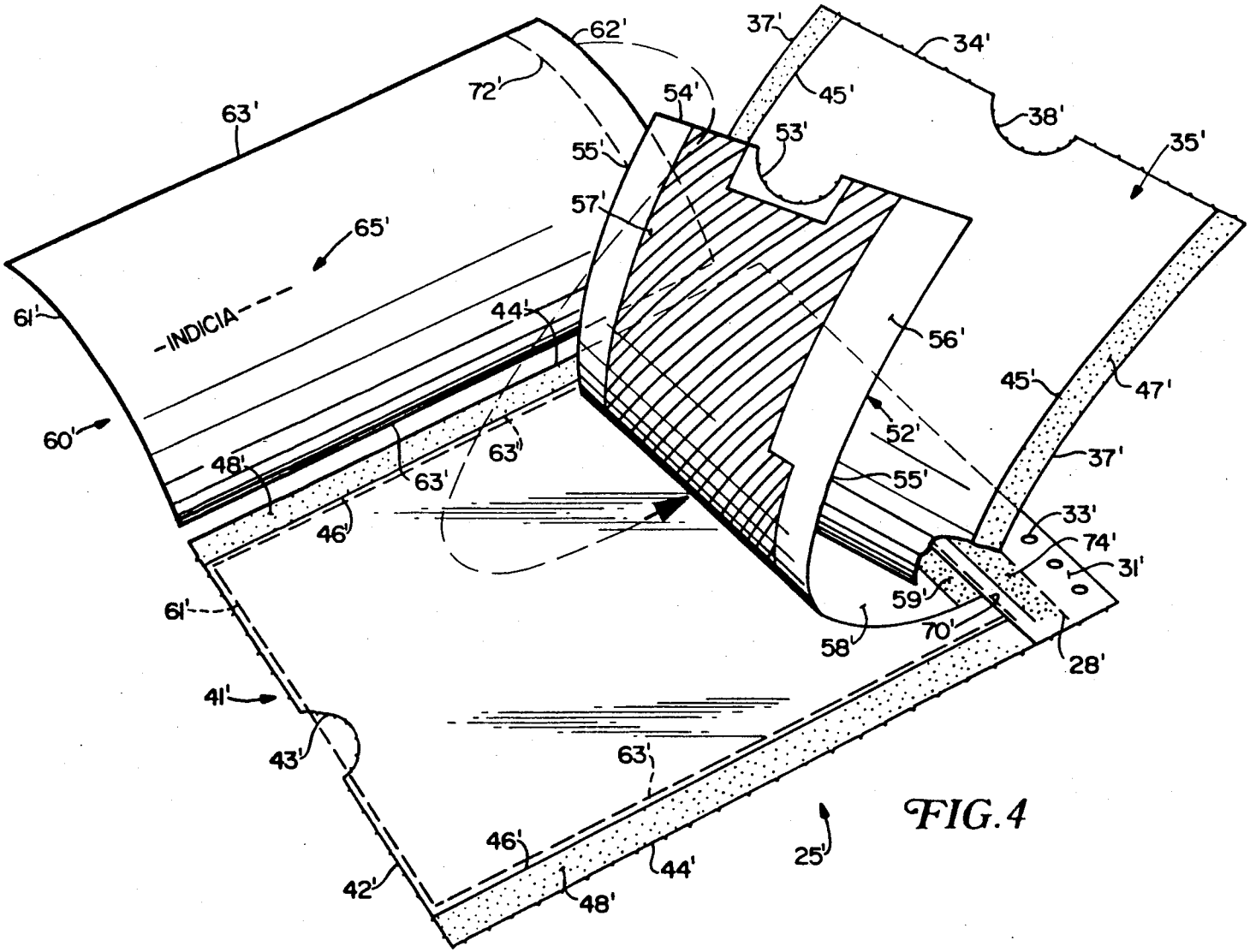
FIG. 4 is a view identical to that of FIG. 3 only showing a slightly different embodiment.
Figure 5:
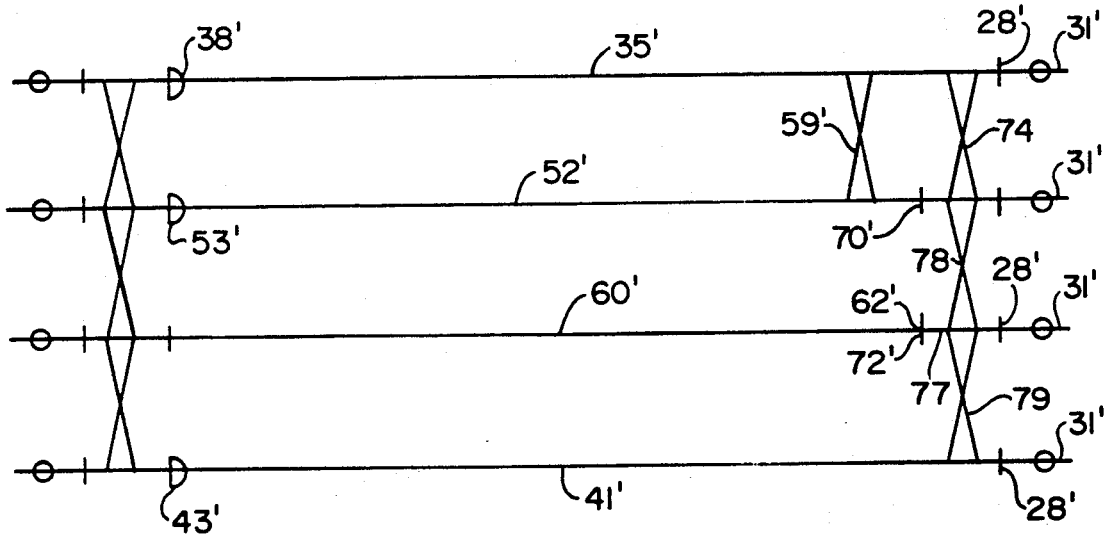
FIG. 5 is a schematic side view of the form of FIG. 4.

A slightly modified form according to the invention is illustrated in FIGS. 4 and 5. In FIGS. 4 and 5 structures substantially identical to those in the FIGS. 1 through 3 embodiment are illustrated by the same reference numeral.

The form of FIGS. 4 and 5 has a longer insert sheet 60' which is attached to the face of the bottom ply 41' along a glue line 79. The glue line is applied to ply 41'. The glue line 79 attaches the ply 41' to the insert sheet 60' at the area 77, which itself does not have adhesive applied thereto. The tractor openings and related marginal portions of insert 60', shown in FIG. 5, are not illustrated in FIG. 4 for simplicity of illustration.

The top ply 35' is pasted to the carbon sheet 52' by glue lines 74 and 59', and the insert sheet 60' is pasted to the bottom of the carbon sheet 52' by glue line 78 (see FIG. 5). Perforations 72' along attached end 62' of insert 60' permits detachment of insert 60' from form 25'. Other than perforation 28' (which facilitates the removal of tractor drive portion 31') the only other perforations on the non-opening side of the form are perforations 72' on the insert, and perforations 70' on the carbonized sheet.

The form 25 of FIGS. 1 and 2 may be simply used. After the variable information has been printed thereon by the user of the form 25, the discrete forms 25 are detached along their side edges 37 from each other, strips 30 and 31 are removed, and form 25 is mailed out to the end user. When the end user receives the form 25 he or she grasps the form at the indicia 40 with his/her right hand, separates the parts of the form along the perforation 34 at the left end to remove the stub with instructions 39 thereon, and then grabs the cooperating thumb notch perforations 38, 43, 53 with his/her left hand and pulls his/her left hand outwardly. This causes complete separation of the notches 38, 43, 53 from the rest of the form, and typically results in removal of the insert 60 due to thumb pressure adjacent the first end 61 thereof in alignment with the thumb notches 38, 43, 53. While the insert 60 is readily removed from the outgoing envelope of the form 25, the carbon sheet 52 remains within the outgoing envelope due to the thumb notch perforations 53, and the adhesive 59 holding it to the interior face of the top ply 35 of the outgoing envelope. The force supplied by adhesive 59 is greater than the strength of the perforations forming notch 53.

It will thus be seen that according to the invention a mailer type business form, and method of manufacture thereof, have been provided which effectively allow removal of an insert from a mailer, while a carbon sheet remains within the mailer. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A business form comprising:

an outgoing envelope formed by a top ply and a bottom ply, each ply having an outside face and an inside face, and first and second side edges, and first and second end edges;

first means for operatively connecting said top and bottom plies together along said side edges;

second means for operatively connecting said top and bottom plies together along said end edges;

first perforation means spaced from said first end edges and generally parallel thereto, for facilitating separation of said end edges from both said plies to allow access from said first end to an interior volume between said plies;

a carbonizing bond sheet having a first face and a second face and first and second ends, said second face having a carbon spot thereon extending to said first end, and said first face in contact with said top ply interior face; said carbonizing bond sheet having a width less than the width of said plies;

means for attaching said carbonizing bond sheet second end to said top ply interior surface adjacent said top ply second end, so that said carbonizing bond sheet first end is adjacent said first perforation means, and said carbon spot extends to said first perforation means; and an insert sheet, disposed between said plies and unconnected thereto at least along said sides, said insert sheet having length and width dimensions less than those of said plies, said carbon spot in contact with a face of said insert sheet.

2. A business form as recited in claim 1 further comprising second perforation means formed in said plies spaced from said second end edge, said carbonizing bond sheet second end adjacent said second perforation means but disposed on the opposite side of said second perforation means form said plies second ends.

3. A business form as recited in claim 2 wherein means for attaching said carbonizing bond sheet second end to said top ply interior surface comprises stream pasting between said carbonizing bond sheet first face and said top ply interior face.

4. A business form as recited in claim 2 further comprising cooperating thumb perforation means formed in said top and bottom plies extending from said first perforation means toward said plies second ends, and in said carbonizing bond sheet at said first end thereof; said insert sheet devoid of cooperating thumb perforation means.

5. A business form as recited in claim 4 wherein means for attaching said carbonizing bond sheet second end to said top ply interior surface comprises stream pasting between said carbonizing bond sheet first face and said top ply interior face.

6. A business form as recited in claim 1 further comprising cooperating thumb perforation means formed in said top and bottom plies extending from said first perforation means toward said plies second ends, and in said carbonizing bond sheet at said first end thereof; said insert sheet devoid of cooperating thumb perforation means.

7. A business form as recited in claim 6 wherein means for attaching said carbonizing bond sheet second end to said top ply interior surface comprises stream pasting between said carbonizing bond sheet first face and said top ply interior face.

8. A business form as recited in claim 6 further comprising indicia formed along the exterior face of the top ply opposite from the thumb perforation means in the top ply, adjacent the second end edge of the top ply, instructing the end user to hold the business form at that point during opening of the business form.

9. A business form as recited in claim 1 wherein means for attaching said carbonizing bond sheet second end to said top ply interior surface comprises stream pasting between said carbonizing bond sheet first face and said top ply interior face.

10. A business form as recited in claim 1 wherein the first and second means for operatively connecting the top and bottom plies together comprise strips of adhesive.

11. A business form as recited in claim 1 wherein the insert sheet is unconnected to the ends of the first and second plies except by the paper bridges left after die cutting.

12. A mailer comprising:

an outgoing envelope formed by a top ply and a bottom ply, each ply having an outside face and an inside face, and first and second side edges, and first and second end edges;

first means for operatively connecting said top and bottom plies together along said side edges;

second means for operatively connecting said top and bottom plies together along said end edges;

first perforation means spaced from said first end edges and generally parallel thereto, for facilitating separation of said end edges from both said plies to allow access from said first end to an interior volume between said plies;

a carbonizing bond sheet having a first face and a second face and first and second ends, said second face having a carbon spot thereon extending to said first end, and said first face in contact with said top ply interior face; said carbonizing bond sheet having a width less than the width of said plies;

an insert sheet, disposed between said plies and unconnected thereto at least along said sides, said insert sheet having length and width dimensions less than those of said plies, said carbon spot in contact with a face of said insert sheet; and cooperating thumb perforation means formed in said top and bottom plies extending from said first perforation means toward said plies second ends, and in said carbonizing bond sheet at said first end thereof; said insert sheet devoid of cooperating thumb perforation means.

13. A mailer as recited in claim 12 further comprising means for affixing said carbonizing bond sheet so that it remains with said first and second plies when said insert sheet is removed.

14. A mailer as recited in claim 13 wherein said affixing means comprises a strip of adhesive between the top ply interior face and carbonizing sheet first face.

15. A mailer as recited in claim 12 wherein the first and second means for operatively connecting the top and bottom plies together comprise strips of adhesive.

16. A mailer as recited in claim 12 further comprising indicia formed along the exterior face of the top ply opposite from the thumb perforation means in the top ply, adjacent the second end edge of the top ply, instructing the end user to hold the business form at that point during opening of the business form.

* * * * *